US009941624B2

(12) United States Patent
Zhang et al.

(10) Patent No.: US 9,941,624 B2
(45) Date of Patent: Apr. 10, 2018

(54) PROTECTOR FOR RF CONNECTOR

(71) Applicant: CommScope Technologies LLC, Hickory, NC (US)

(72) Inventors: Yujun Zhang, Suzhou (CN); Jin Liu, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 15/191,897

(22) Filed: Jun. 24, 2016

(65) Prior Publication Data

US 2017/0062972 A1 Mar. 2, 2017

(30) Foreign Application Priority Data

Jun. 30, 2015 (CN) ..... 2015 1 0373117

(51) Int. Cl.
*H01R 4/70* (2006.01)
*H01R 13/52* (2006.01)
*H01R 24/40* (2011.01)

(52) U.S. Cl.
CPC ..... *H01R 13/5221* (2013.01); *H01R 13/5205* (2013.01); *H01R 13/5213* (2013.01); *H01R 24/40* (2013.01)

(58) Field of Classification Search
CPC ..... H02G 15/18; H02G 15/04; H01R 4/70; H01R 4/22; H01R 13/5216; H01R 13/5213; H01R 13/6392
USPC ..... 174/138 F, 76; 439/521, 367
See application file for complete search history.

(56) References Cited

U.S. PATENT DOCUMENTS 3,710,307 A * 1/1973 Cooper, Jr. ..... H01R 11/26 439/523
4,593,962 A * 6/1986 Knorreck ..... H01R 13/74 439/277
5,226,837 A * 7/1993 Cinibulk ..... H01R 13/5216 439/521
5,297,976 A * 3/1994 Vanderstuyf ..... H01R 13/5219 439/271
5,627,343 A * 5/1997 Brandolf ..... H02G 3/22 156/86
6,007,378 A * 12/1999 Oeth ..... H01R 13/5213 439/279
6,109,945 A * 8/2000 Creelle ..... H01R 13/5219 439/278
2009/0215306 A1* 8/2009 Hanks ..... H01R 4/5033 439/427
2014/0097022 A1 10/2014 Vaccaro

* cited by examiner

*Primary Examiner* — Hien Vu
(74) *Attorney, Agent, or Firm* — Myers Bigel, P.A.

(57) ABSTRACT

A protector for an RF connector includes a first sealing assembly for connection with a cable and a second sealing assembly for connection with a communication equipment. The first sealing assembly includes a sealing ring for matching with a sheath of the cable and a member which has an internal thread or elastic structure for matching with the RF connector. The second sealing assembly is provided with an elastic silicone rubber jacket for connection with the communication equipment.

5 Claims, 7 Drawing Sheets

PROTECTOR FOR RF CONNECTOR

RELATED APPLICATION

The present application claims priority from and the benefit of Chinese Patent Application No. 201510373117.9, filed Jun. 30, 2015, the disclosure of which is hereby incorporated herein in its entirety.

FIELD OF THE INVENTION

The present invention generally relates to a protector for a RF connector and in particular relates to a protector for a RF connector mounted outdoors.

BACKGROUND OF THE INVENTION

A RF device connector (hereinafter referred to as an RF connector or a connector) for communication equipment is an electromechanical element for connecting a conductor (for example, a wire) with an appropriate paired device, thereby enabling connection and disconnection of microwave signals. In existing communication products, a ½" RF coaxial cable and coaxial RF connectors mounted at the two ends of the cable are generally adopted for RF signal transmission between a commonly used remote radio unit (RRU) and an antenna. In order to prevent water from permeating along the cable from the RF connector (which may affect safe and stable operation of the cable and the communication equipment), waterproof sealing treatment is performed on a portion of the RF connector connected to the communication equipment or the smart antenna.

Traditional waterproof sealing treatment mainly includes four techniques: namely, a waterproof cement adhesive tape winding, a waterproof heat-shrinkable sleeve, a waterproof cold-shrinkable sleeve and a waterproof box. The waterproof cement adhesive tape winding method is relatively widely used, but in equipment with compact space, this method can be extremely difficult and require extreme time and labor. As the cement in the center of the interface easily expands and overflows under heating, the service life is typically only 2-3 years and regular maintenance and replacement are required, and the subsequent maintenance cost and disconnection may be difficulty. Additionally, if a technician winds the cement adhesive tape incorrectly, it may lead to poor waterproofing. The heat-shrinkable sleeve requires a special heating tool and thus has certain limitations during outdoor construction. The cold-shrinkable sleeve and the waterproof box are relatively convenient, but relatively high in cost, and the waterproofing of the two methods may be unreliable; moreover, subsequent maintenance using these two methods may also be quite complex and time-consuming.

In a mobile communication system, passive intermodulation (PIM) is gradually becoming a major cause of interference. PIM refers to a passive intermodulation product produced when the RF signal power of two or more frequencies appear in a passive device simultaneously; such a passive intermodulation product is a mixed signal produced due to a nonlinear characteristic of connection of heterogeneous materials, wherein one representative mixed signal is called a third-order intermodulation signal. The passive intermodulation product may interfere with a receiver, and may lead to abnormal operation of the receiver in a severe case; hence, it can be crucial to suppress or eliminate PIM.

With the constant development of communication systems, increasingly high PIM performance is required of connectors and jumpers, in particular dynamic passive intermodulation performance. Existing coaxial connectors are mainly reinforced with welds and/or via injection molding. However, to mount connectors outdoors, an on-site technician needs to manually mount cables, and pre-assembled connectors are mostly used. As the cables are typically flexible coaxial cables, when the cables bend or twist significantly, the contact surfaces of the contact portions between the ends of the cables and the connectors may be separated and deformed to a certain extent, leading to degradation of PIM performance. In one proposed solution, the tail nuts of the connectors generally are lengthened to protect the ends of the cables and to stabilize connected sections; however, this method typically results in high-cost connectors.

U.S. Patent Publication No. US2014/0097022A1 describes a sealing element for interconnection of a cable and a connector, wherein the sealing element comprises an integrated elastic body and a main duct penetrating through the elastic body. The main duct is provided with a main cable outer diameter sealing portion at a cable end. The main cable outer diameter sealing portion is adjacent to a main connector cavity portion, which is adjacent to a coupling nut cavity portion, and the coupling nut cavity portion is adjacent to a connector necking sealing portion at a connector end. The coupling nut cavity portion is longitudinally aligned to a coupling nut of a connector and designed to have a greater inner diameter than the main cable outer diameter sealing portion and the connector necking sealing portion. It may be desirable to seek further solutions to improve PIM performance.

SUMMARY

A protector for a RF connector according to embodiments of the present invention can improve the waterproof sealing efficiency and the PIM performance of the connector; protection can be achieved by using only one protector that is convenient to mount, easy to maintain and low in cost.

Embodiments of the present invention are directed to a protector for a RF connector; wherein the protector comprises a first sealing assembly for connection with a cable and a second sealing assembly for connection with communication equipment. The first sealing assembly comprises a sealing ring for engaging with a sheath of the cable and a member which has an internal thread or elastic structure for matching with the RF connector. The second sealing assembly is provided with an elastic silicone rubber jacket for connection with the communication equipment. The protector for the RF connector is a mechanical self-sealed protector, and by means of combined sealing, protection and support of the first sealing assembly and the second sealing assembly, both efficient waterproof sealing and good passive intermodulation performance may be achieved.

In some embodiments, the first sealing assembly and the second sealing assembly are connected in a secondary injection molding manner or bonded by using an adhesive.

In some embodiments, the sealing ring of the first sealing assembly is an O-shaped ring.

In some embodiments, the sealing ring of the first sealing assembly is made of silicone rubber.

In some embodiments, the threaded member of the elastic structure of the first sealing assembly is made of rigid plastic, such as polyethylene plastics (PE) or polypropylene plastics (PP).

In some embodiments, the threaded member of the elastic structure of the first sealing assembly internally comprises a grooved elastic claw structure for interconnection with the connector.

In some embodiments, the second sealing assembly is made of silicone rubber.

Embodiments of the invention are further directed to an RF connector protected by using the above-mentioned protector.

Embodiments of the invention are also directed to a mounting method of the above-mentioned protector. The mounting method may comprises at least some of the following steps: coating the surface of a sheath of a cable with a lubricating grease such that the protector directly sleeves the cable; stripping off an outer insulator and a wire core of the cable according to a mounting size appropriate for a mating connector; assembling a cable-end connector and pairing the mounted cable-end connector with a communication equipment-end connector; after the assembly of the cable-end connector with the communication equipment-end connector is completed, pulling back the first sealing assembly such that the first sealing assembly sleeves a tail portion of the cable-end connector; pulling the second sealing assembly such that the second sealing assembly is fastened to a front end portion of the cable-end connector; and firmly holding the first sealing assembly such that the first sealing assembly clamps the cable-end connector, and pulling outwardly the head of the second assembly such that the second sealing assembly encapsulates the equipment-end connector.

BRIEF DESCRIPTION OF THE DRAWINGS

Various goals, features and advantages of the present invention will be more apparent by considering the following detailed descriptions of preferred embodiments thereof in combination with the accompanying drawings. The accompanying drawings are merely exemplary illustrations of the present invention, and not certainly scaled. Same reference signs represent the same or similar components throughout the accompanying drawings.

DETAILED DESCRIPTION OF EMBODIMENTS OF THE INVENTION

A protector for a RF connector according to the present invention is described with reference to the accompanying drawings. The description and the accompanying drawings are merely exemplary in essence rather than limiting the protection scope of appended claims in any way.

Unless otherwise defined, all technical and scientific terms that are used in this disclosure have the same meaning as commonly understood by one of ordinary skill in the art to which this invention belongs. The terminology used in the below description is for the purpose of describing particular embodiments only and is not intended to be limiting of the invention. As used in this disclosure, the singular forms "a", "an" and "the" are intended to include the plural forms as well, unless the context clearly indicates otherwise. It will also be understood that when an element (e.g., an assembly, a housing, a cable, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

As shown in FIGS. 1-4, a protector for an RF connector according to embodiments of the present invention comprises a first sealing assembly 1 for connection with a cable and a second sealing assembly 2 for connection with communication equipment, such as an RRU. The first sealing assembly 1 comprises a member 11 which has an internal thread or elastic structure for mating with a connector, and a sealing ring 12 for attaching to a sheath of the cable. The member 11 of the elastic structure may be made of rigid plastic (for example, PE or PP). The sealing ring 12 may be made of silicone rubber or the like. The second sealing assembly 2 is provided with an elastic silicone rubber jacket for connection with communication equipment. The first sealing assembly 1 and the second sealing assembly 2 may be attached to each other in a secondary injection molding operation, bonded by using an adhesive, or connected through other means. The sealing ring 12 is directly placed in an inner wall groove of the member 11. The specific structure of the second sealing assembly 2 may be similar to that in U.S. Patent Publication No. US2014/0097022A1, supra, the disclosure of which is hereby incorporated herein in its entirety.

Figure 1:
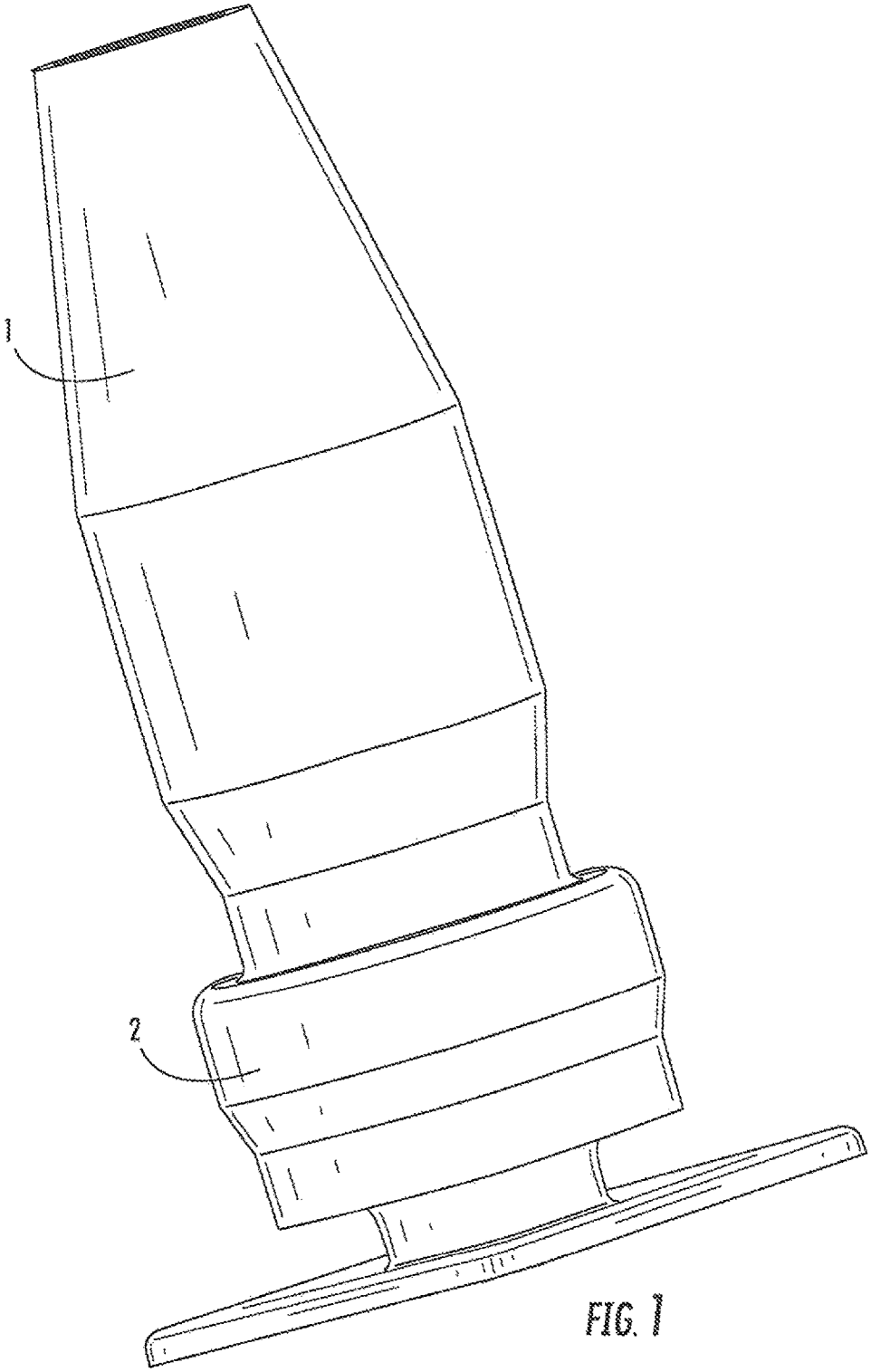
FIG. 1 is a schematic diagram of a protector for a RF connector according to an embodiment of the present invention.
Figure 2:
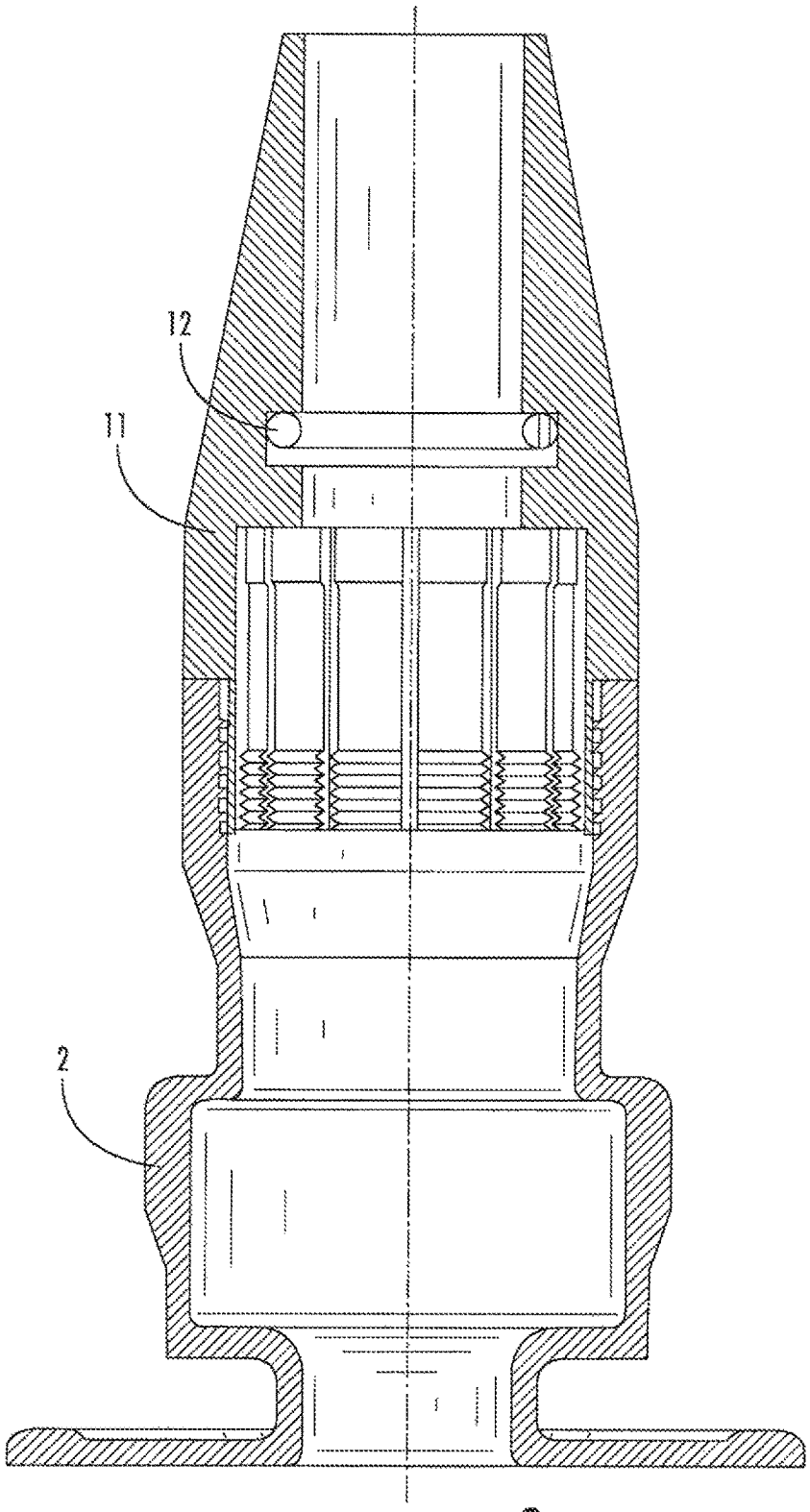
FIG. 2 is a sectional view of a protector for a RF connector according to an embodiment of the present invention.

As shown in FIG. 2, the sealing ring 12 employed in embodiments of the present invention may be an O-shaped ring, and the cross-section of the O-shaped ring may be circular. Optionally, the section of the O-shaped ring also may be elliptical, rectangular or in other appropriate shape, as long as a good sealing effect can be ensured.

Figure 3:
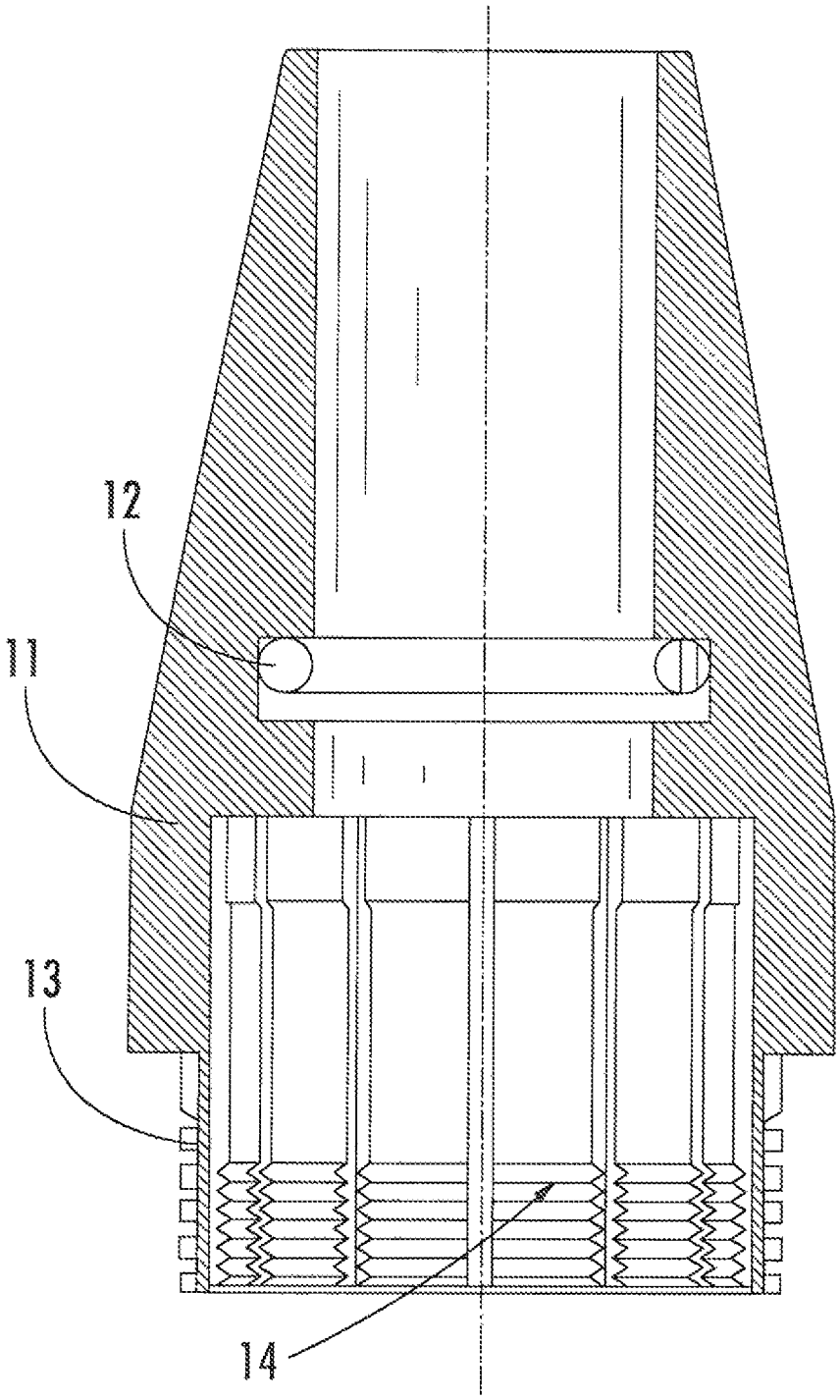
FIG. 3 is a schematic diagram of a first sealing assembly in a protector according to an embodiment of the present invention.

As shown in FIG. 3, a wall-type step portion 13 is arranged circumferentially at the left (connector) end of the first sealing assembly 1; the step portion 12 can increase the friction coefficient when the first sealing assembly 1 and the second sealing assembly 2 are connected via injection molding manner or adhesive bonding and therefore increase the adhesion force between the two assemblies 1, 2. The grooves in the step portion 13 as shown in FIG. 3 are of a rectangular shape; they also can be designed to be a semi-circular or trapezoidal grooves in other embodiments.

As shown in FIG. 3, an elastic claw structure 14 is arranged in an inner bore of the left end of the first sealing assembly 1. The elastic claw structure 14 comprises annular grooves on its inner surface, and is provided with axial grooves. The grooved design of the elastic claw structure 14 is to facilitate deformation of the claw structure 14, such that the first sealing assembly 1 can be pushed onto a tail nut of the connector by hand when the annular stepped portion 13 is matched with the tail portion of the connector. As a result, the tail nut can be clamped or fastened without any auxiliary tool, thereby realizing reliable fixation.

In use, the first sealing assembly 1 of the protector is used for protecting a cable and providing waterproof sealing protection, as well as fastening the cable and a connector at a cable end to achieve stabilization and reinforcement. In addition, stable passive intermodulation performance of the connector can be improved/ensured. The second sealing assembly 2 of the protector is used for protecting a communication equipment-end connector, thereby providing waterproof sealing protection.

Figure 4:
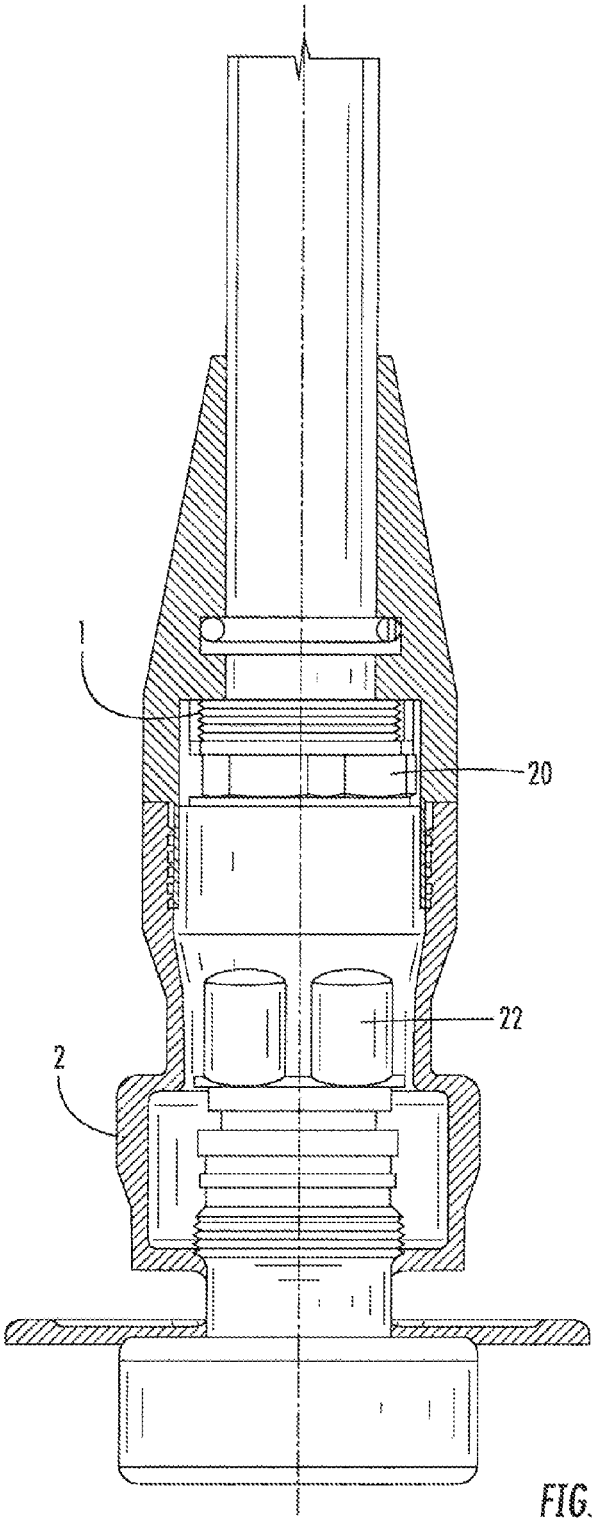
FIG. 4 is a schematic diagram of a second sealing assembly in a protector according to an embodiment of the present invention.
Figure 5:
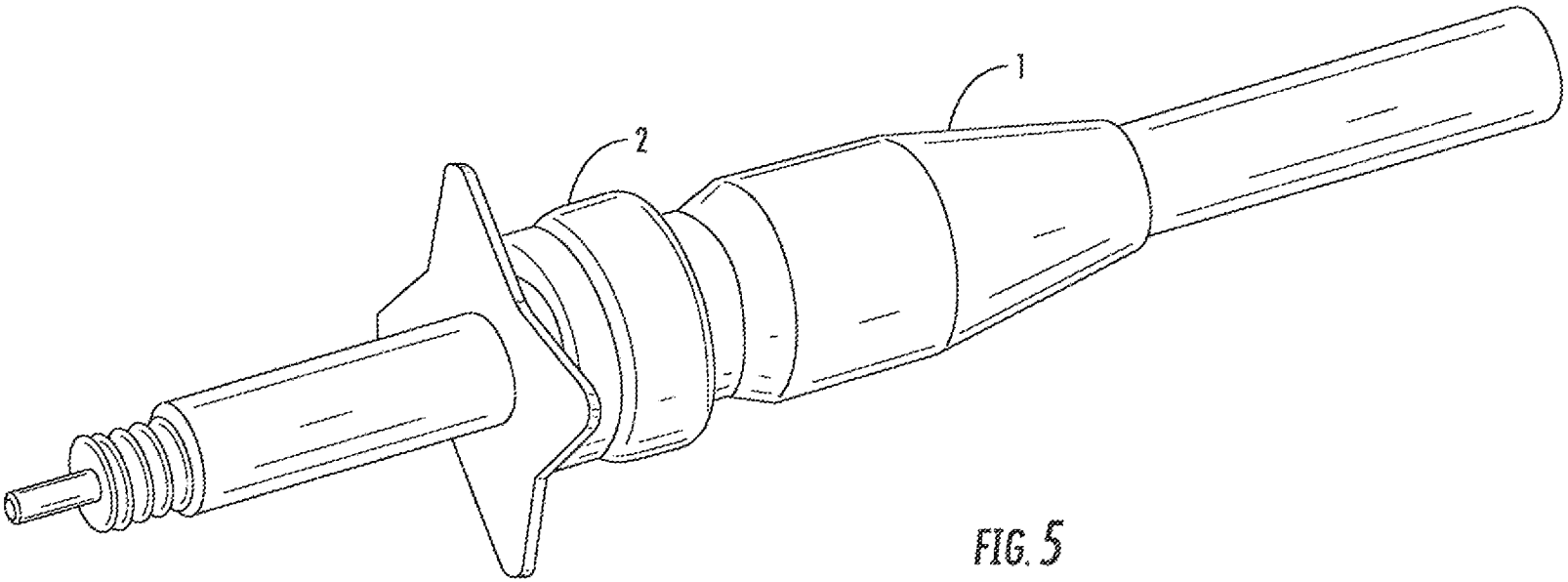
FIGS. 5-7 are schematic diagrams of mounting operations of a protector according to an embodiment of the present invention.
Figure 6:
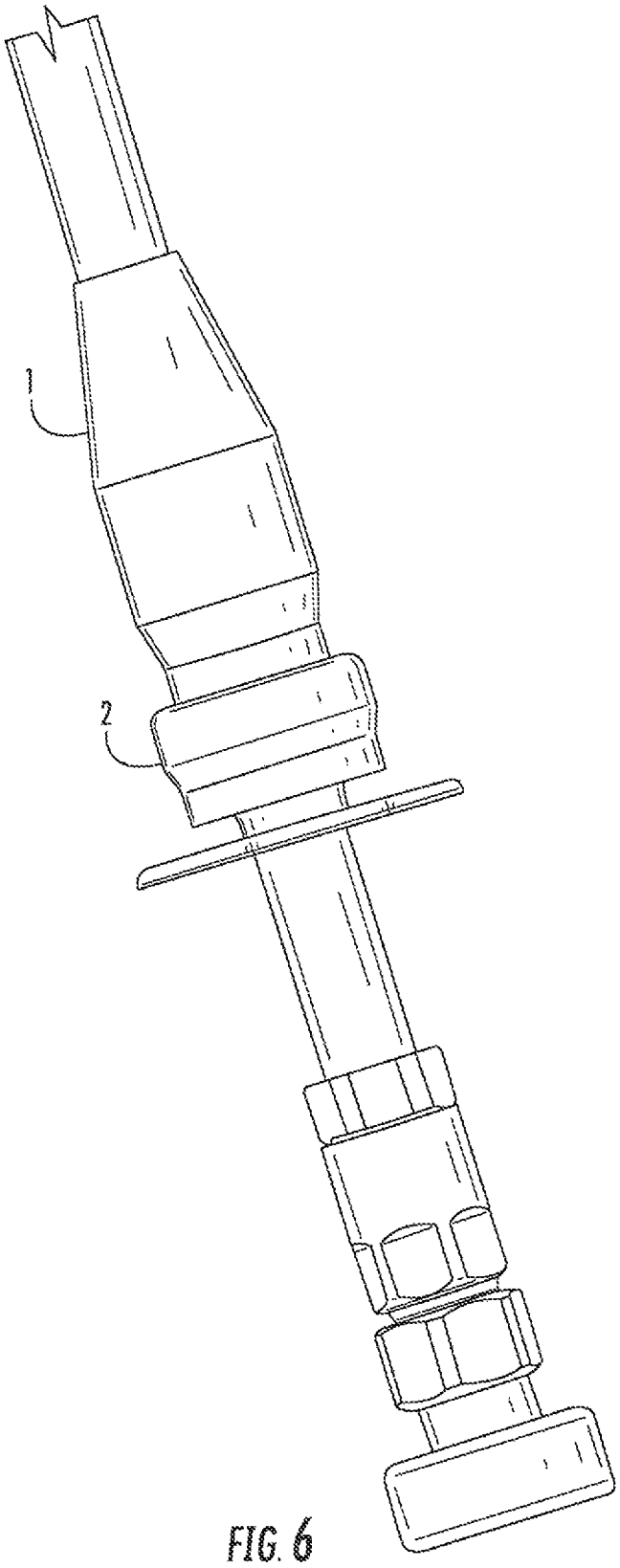
Figure 7:
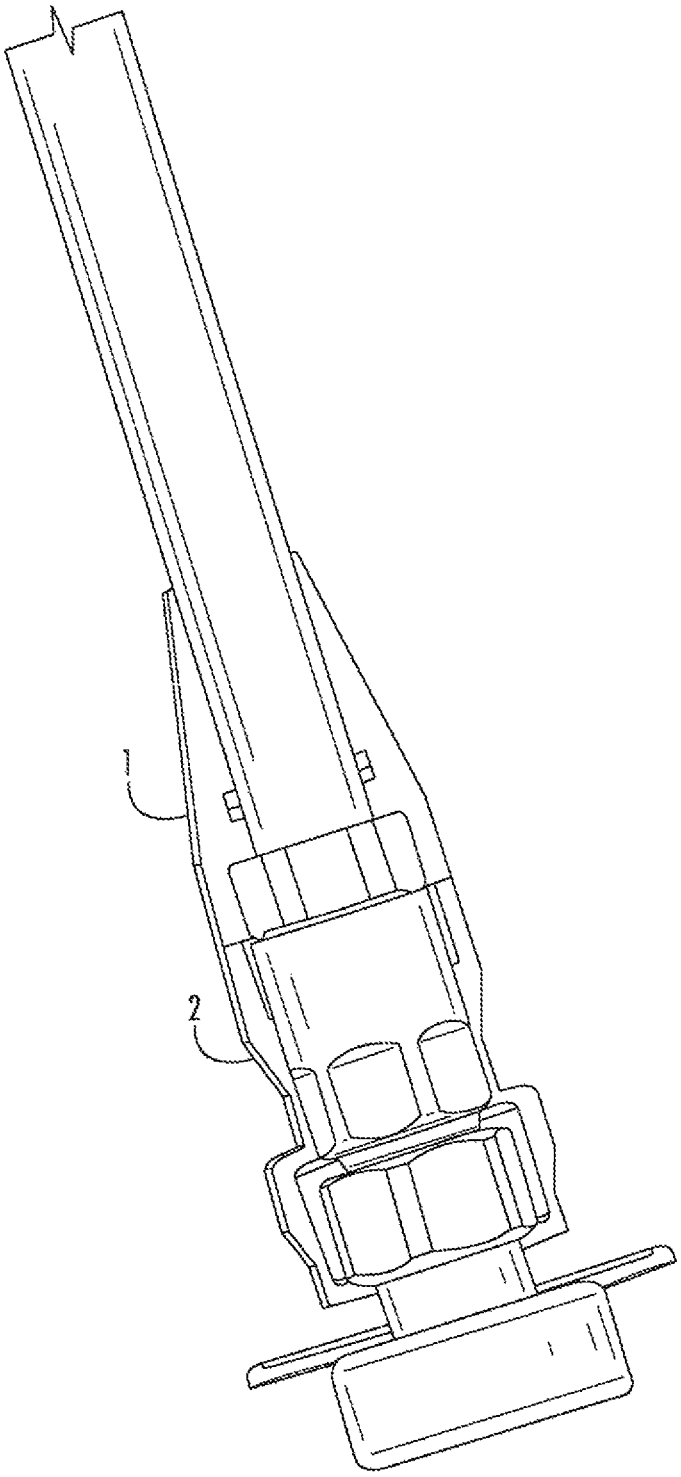

As shown in FIGS. 5-7, in the mounting process of the protector according to the embodiments of the present invention, the following steps may be involved: firstly, coating the surface of a sheath of a cable with a lubricating grease such that the protector directly sleeves the cable; stripping off the outer insulation, the wire core and the like of the cable according to the mounting size requirement of the mating connector; next, attaching a cable-end connector to the cable, pairing and securing the mounted cable-end connector with a communication equipment-end connector; after the assembly of the cable-end connector with the communication equipment-end connector is completed, firmly holding and pulling back the first sealing assembly 1 such that the first sealing assembly 1 sleeves a tail portion of the cable-end connector; next, pulling the second sealing assembly 2 such that the second sealing assembly 2 covers at least a front end portion of the cable-end connector; and then, firmly holding the first scaling assembly 1 such that the first sealing assembly clamps the cable-end-connector 20, pulling outwardly the head of the second assembly 2 such that the second sealing assembly 2 at least partially encapsulates the equipment-end connector 22, as shown in FIG. 4.

Removal of the protector and the connectors can be realized conveniently through an operation process in a reverse order of the above-mentioned mounting process.

The cable is fastened to the connector through a mechanically rigid material to maintain a stable locked state in practical use, and therefore reliable PIM performance can be realized. In addition, according to the waterproof protector of the present invention, waterproof protection is achieved through the elastic effect of the flexible silicone rubber material. As a result, the waterproof protector can be mounted quickly for use, and also can be repeatedly mounted for use, thereby remedying failures due to repeated mounting of prior art devices.

Although the present invention is disclosed with reference to some embodiments, various variations and modifications can be made to the embodiments without departing from the range and scope of the present invention. Hence, it should be appreciated that the present invention is not limited to the described embodiments and the protection scope of the present invention should be defined by the contents of appended claims and equivalent structures and solutions thereof.

The invention claimed is:

1. A RF connector, comprising a first sealing assembly to cover a cable and a second discrete sealing assembly connecting with the first sealing assembly to cover a communication equipment, wherein the first sealing assembly comprises a sealing ring for matching with a sheath of the cable and a member which has an internal thread or elastic structure for matching with the RF connector, the member comprising a deformable claw structure with a plurality of longitudinal grooves extended along a longitudinal axis of the first sealing assembly; wherein the second sealing assembly is provided with an elastic silicone rubber jacket to cover and protect the communication equipment; and wherein each of the first sealing assembly and the second discrete sealing assembly has different material.

2. The protector of claim 1, wherein the sealing ring, of the first sealing assembly is an O-shaped ring.

3. The protector of claim 1, wherein the sealing ring of the first sealing assembly is made of silicone rubber.

4. The protector of claim 1, wherein the member of the elastic structure of the first sealing assembly is made of rigid plastic.

5. The protector of claim 4, wherein the member of the elastic structure of the first sealing assembly is made of polyethylene polypropylene.

* * * * *